US005214344A

United States Patent [19]

Kogelschatz

[11] Patent Number: 5,214,344

[45] **Date of Patent: * May 25, 1993**

[54] HIGH-POWER RADIATOR

[75] Inventor: Ulrich Kogelschatz, Hausen, Switzerland

[73] Assignee: Asea Brown Boveri Ltd., Baden, Switzerland

[ * ] Notice: The portion of the term of this patent subsequent to May 7, 2008 has been disclaimed.

[21] Appl. No.: 691,832

[22] Filed: Apr. 26, 1991

[30] Foreign Application Priority Data

May 22, 1990 [CH] Switzerland ..... 1738/90

[51] Int. Cl.[5] ..... H01J 61/04; H01J 61/30

[52] U.S. Cl. ..... 313/17; 313/36; 313/232; 313/234; 313/607; 313/634

[58] Field of Search ..... 313/17, 24, 35, 36, 313/232, 234, 358, 586, 607, 634

[56] References Cited

U.S. PATENT DOCUMENTS 4,038,577 7/1977 Bode et al. ..... 313/586
4,837,484 6/1989 Eliasson et al. ..... 313/634
5,013,959 5/1991 Kogelschatz ..... 313/36

FOREIGN PATENT DOCUMENTS 0254111 1/1988 European Pat. Off. .
0385205 9/1990 European Pat. Off. .

OTHER PUBLICATIONS

Gesellschaft Deutscher Chemiker, Nov. 18-20, 1987, pp. 23-25, U. Kogelschatz, et al., "NEUE UV-Und VUV-Excimerstrahler" (New UV and VUV Excimer Radiators).

*Primary Examiner*—Donald J. Yusko
*Assistant Examiner*—Ashok Patel
*Attorney, Agent, or Firm*—Oblon, Spivak, McClelland, Maier & Neustadt

[57] ABSTRACT

In order to be able in the case of UV high-power omni-directional radiators to direct the generated radiation only in a preferred direction, and to avoid shading by the inner dielectric tube (2), the outer electrodes (4) are arranged only on a part of the circumference of the outer dielectric tubes (1). In this way, the object to be irradiated or the substance to be irradiated can thus be arranged directly in the range of emission of the discharges (7).

10 Claims, 1 Drawing Sheet

Fig. 1a
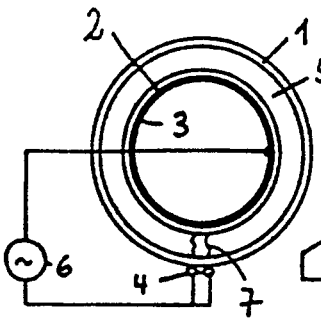
Fig. 1b
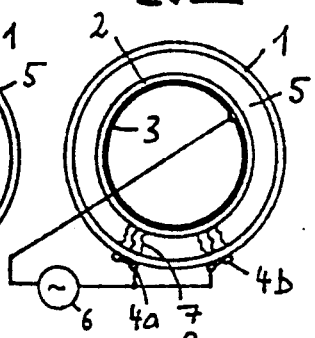
Fig. 1c
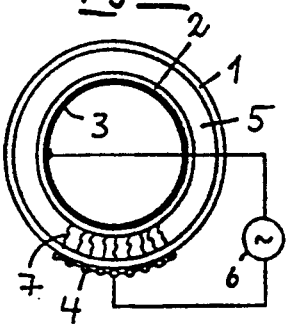
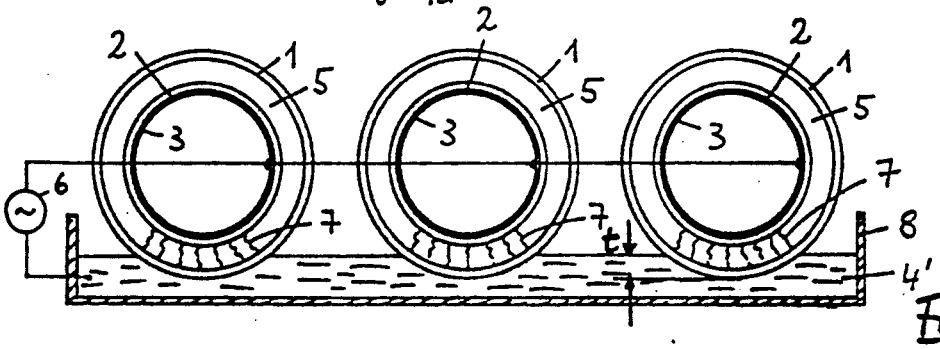
Fig. 2
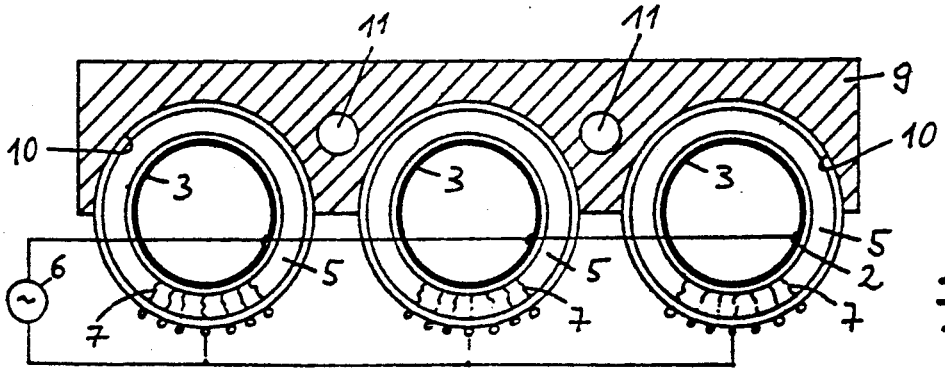
Fig. 3
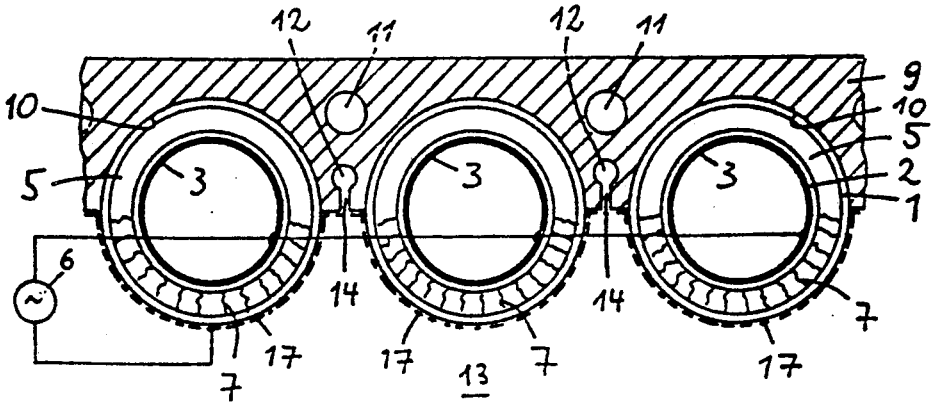
Fig. 4

HIGH-POWER RADIATOR

BACKGROUND OF THE INVENTION

1. Field of the Invention

The invention relates to a high-power radiator, in particular for ultraviolet light, having a discharge space which is filled with a fill-gas emitting radiation under discharging conditions and whose walls are formed by an outer and an inner tubular dielectric which are provided in each case on the surfaces averted from the discharge space with an inner and an outer electrode, and having an alternating current source for feeding the discharge connected to these electrodes.

The invention refers in this regard to a prior art such as emerges for example, from EP-A 0,254,111, corresponding to U.S. Pat. No. 4,837,484 the U.S. Pat. No. 5,013,959.

2. Discussion of Background

The industrial use of photochemical processes depends strongly on the UV sources suitable for availability. The classic UV radiators deliver low to medium UV intensities at a few discrete wavelengths such as, for example, the low-pressure mercury lamps at 185 nm and, in particular, at 254 nm. Truly high UV outputs are obtained only from high-pressure lamps (Xe, Hg), which then, however, distribute their radiation over a larger range of wavelengths. The new excimer lasers have provided a few new wavelengths for photochemical basic experiments, and for reasons of cost are presently suitable for an industrial process probably only in exceptional cases.

In the EP Patent Application named at the beginning, or else in the printed conference publication "Neue UV- und VUV Excimerstrahler" ("New UV and VUV Excimer Radiators") by U. Kogelschatz and B. Eliasson, distributed at the 10th Lecture Conference of the Society of German Chemists, Specialist Group for Photochemistry, in Wurzburg (FRG) 18–20th November 1987, there is a description of a new excimer radiator. This new type of radiator is based on the principle that excimer radiation can also be generated in silent electrical discharges, a type of discharge which is used on a large industrial scale in ozone generation. In the current filaments of this discharge, which are present only briefly (<1 microsecond), rare gas molecules are excited by electron collision and further react to form excited molecule complexes (excimers). These excimers live only a few 100 nanoseconds, and release their binding energy upon decay in the form of UV radiation.

The structure of such an excimer radiator largely corresponds to that of a classic ozone generator, with the essential difference that at least one of electrodes and/or dielectric layers limiting the discharge space is transparent to the radiation generated.

The high-power radiators mentioned are typified by high efficiency and an economic structure, and permit the creation of sizeable large-area radiators, with the restriction that large-format flat radiators rather require a high technical outlay. In the known cylindrical radiators, by contrast, a considerable proportion of the radiation is not utilized due to the shading effect of the inner electrode. In order, now, to increase the yield in cylindrical radiators, in the case of the conventional radiators the inner dielectric tubes are very small by comparison with the outer dielectric tubes. A preferred direction of the emission is achieved through an eccentric arrangement of the inner dielectrics, having a small diameter by comparison with the diameter of the outer dielectrics, and of the outer electrodes only on the surface adjoining the inner dielectric, and the simultaneous formation of the outer electrode as a reflector.

SUMMARY OF THE INVENTION

Accordingly, one object of the invention is, starting from the prior art, to provide a novel high-power radiator, in particular for UV or VUV radiation, which is typified in particular by high efficiency, is economically produced permits the construction of very sizeable large-area radiators, and in which the UV radiation can be purposely concentrated on an angle of emission selectable within wide limits, and the inner electrode is no longer able to cast a shadow.

For the purpose of achieving this object, it is provided in the case of a high-power radiator of the generic type mentioned at the beginning that the outer electrode extends only over a fraction of the outer circumference of the outer dielectric tube way that discharges form only in a discharge, space essentially defined by the outer electrode.

In this way, the radiation can be coupled out in a defined direction, and this is advantageous in particular in the case of the irradiation of flat or curved surfaces, since the electrical discharges can be formed only on the surface facing the item to be irradiated. Apart from the wire nettings or wire fabrics already described in the relevant literature, electrically conductive, UV-transparent coatings, for example of conductor varnish or thin metal films, can also serve as outer electrodes.

It is also possible to construct the outer electrode in fluid form, in that the outer tube is immersed only partially in a transparent electrolyte, preferably water. This arrangement is suitable, in particular, for the irradiation of temperature-sensitive substances (for example bonding of LCD cells, irradiation of thin foils), because water very effectively blocks any possibly present infrared radiation from the discharge. The eletrolyte can be circulated via a thermostat and held in this way at a constant low temperature. In addition, an optical filtering effect can be achieved by a suitable selection of the electrolyte. Moreover, the angular range of the triggered segment can be varied via the depth of immersion of the outer tube in the electrolyte.

The inner electrode is preferably classically constructed, i.e. consists of a metal coating, for example aluminum deposition, applied to the inner surface of the inner dielectric tube. In this way, the inner electrode acts simultaneously as a reflector for the UV radiation. If cooling is desired, a coolant flow (gas or liquid) can be lead through the inner tube.

A plurality of such radiators can easily be combined into blocks which are suitable for the irradiation of large surfaces. For this purpose, it is advantageous to arrange the outer tubes in groove-shaped semicylindrical recesses in a carrier body made of an electrically insulating, but effectively thermally conducting material. Such material exist on a ceramic base, for example aluminum nitride (AlN) or beryllium oxide (BeO), as well as on a plastic base (casting compounds for transformers and electrical circuits). In the case of less extreme requirements, more conventional materials such as aluminum oxide ($Al_2O_3$), glass ceramic or heat-resistant plastics such as polytetrafluorothylene, come into consideration. In the case of higher outputs, it is possible to cool the carrier body and thus the outer tubes by, for example, providing in the carrier body cooling ducts extending in the longitudinal direction of the tube.

The reflectivity of the semicylindrical recesses in the carrier body can be improved by a metallization, for example an aluminum layer with an overlying protective layer of magnesium fluoride ($MgF_2$). However, it can also prove to be advantageous to apply a diffusely reflecting layer, such as is used in radiometry in the so-called Ulbricht sphere In this case, a layer of magnesium oxide (MgO) or barium sulfate ($BaSO_4$) would be used.

In the UV treatment of surfaces and the curing of UV paints and UV varnishes, it is advantageous in specific instances not to work in air. There are at least two reasons which seem to indicate UV treatment with the exclusion of air. The first reason is that the radiation is attenuated if the radiation is of so short a wavelength it is absorbed by air (wavelengths <190 nm). This radiation leads to oxygen splitting and thus to undesired ozone formation. The second reason is present is that the presence of oxygen may prevent the intended photochemical effect of the UV radiation (oxygen inhibition). This instance occurs, for example, in the photocrosslinking (UV polymerization, UV drying) of varnishes and paints. These processes are known per se and described, for example, in the book "U. V. and E. B. Curing Formulation for Printing Ink, Coatings and Paints", published in 1988 by SITA-Technology, 203 Gardiner House, Broomhill Road, London SW18, pages 89–91. In these instances, it is envisaged to provide means for rinsing the treatment chamber with an inert UV-transparent gas such as, for example, nitrogen or argon. Particularly in the case of configurations in which the first tubes are arranged in a carrier body provided with grooves, it is possible to realize such a rinsing without high technical outlay, for example by means of additional ducts fed from an inert gas source and open towards the discharge space. Moreover, the inert gas introduced through certain ducts can be used for cooling the radiator, so that it is possible in some applications to dispense with separate cooling ducts.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 1*a*, 1*b* and 1*c* show a first exemplary embodiment of a cylindrical radiator with a concentric arrangement of the inner dielectric tube, in cross-section with different electrode arrangements on the outer dielectric tube;

FIG. 2 shows a UV radiator having an outer electrode in fluid form;

FIG. 3 shows an embodiment of an irradiating device having three neighboring cylindrical radiators in accordance with FIG. 1*c*, which are arranged on a carrier body made of insulating material; and FIG. 4 an embodiment of an irradiating device similar to FIG. 3, but having an outer electrode covering the entire free surface of the outer dielectric tube.

DESCRIPTION OF THE PREFERRED EMBODIMENTS

Referring now to the drawings, wherein like reference numerals designate identical or corresponding parts throughout the several views, in FIGS. 1*a* to 1*c* an inner quartz tube 2 is arranged coaxially in an outer quartz tube 1 having a wall thickness of approximately 0.5 to 1.5 mm and an outside diameter of approximately 20 to 30 mm. The inner surface of the inner quartz tube 2 is provided with an inner electrode 3, which is produced, for example, by coating with aluminum. An outer electrode 4 in the form of a narrow strip of wire netting extends only over a small part of the circumference of the outer quartz tube 1. The quartz tubes 1 and 2 are sealed at both ends. The space between the two tubes 1 and 2, the discharge space 5, is filled with a gas/gas mixture emitting radiation under discharging conditions. The two electrodes 3, 4 are connected to the two poles of an alternating current source 6. The alternating current source basically corresponds to those such as are used to feed ozone generators. Typically, it delivers an adjustable alternating voltage of the order of magnitude of several 100 volts to 20,000 volts are frequencies in the range of industrial alternating current up to a few 1,000 kHz—depending upon the electrode geometry, the pressure in the discharge space and the composition of the fill-gas.

The fill-gas is, for example, mercury, a rare gas, a mixture of rare gas and metal vapor, a mixture of rare gas and halogen, possibly with the use of an additional further rare gas, preferably Ar, He, Ne, as buffer gas.

Depending on the desired spectral composition of the radiation, it is possible here to use a substance/mixture of substances in accordance with the following table:

| Fill-gas | Radiation |
|---|---|
| Helium | 60–100 nm |
| Neon | 80–90 nm |
| Argon | 107–165 nm |
| Argon + Fluorine | 180–200 nm |
| Argon + Chlorine | 165–190 nm |
| Argon + Krypton + Chlorine | 165–190 nm, 200–240 nm |
| Xenon | 160–190 nm |
| Nitrogen | 337–415 nm |
| Krypton | 124 nm, 140–160 nm |
| Krypton + Fluorine | 240–255 nm |
| Krypton + Chlorine | 200–240 nm |
| Hg | 185 nm, 254 nm, 320–370 nm 390–420 nm |
| Selenium | 196 nm, 204 nm, 206 nm |
| Deuterium | 150–250 nm |
| Xenon + Fluorine | 340–360 nm, 400–550 nm |
| Xenon + Chlorine | 300–320 nm |
| Argon + Bromine | 150–190 nm |
| Krypton + Bromine | 190–250 nm |
| Xenon + Bromine | 260–340 nm |
| Krypton + Iodine | 150–230 nm |
| Xenon + Iodine | 240–330 nm |
| Hg + Iodine + Rare gas | 400–510 nm |
| Hg + Bromine + Rare gas | 490–570 nm |
| Hg + Chlorine + Rare gas | 530–570 nm |

A whole range of further fill-gases additionally comes into consideration:

- A rare gas (Ar, He, Kr, Ne, Xe) or Hg with a gas or vapor from $F_2$, $I_2$, $Br_2$, $Cl_2$ or a compound which splits off in the discharge one or more atoms of F, I, Br or Cl;
- a rare gas (Ar, He, Kr, Ne, Xe) or Hg with $O_2$ or a compound which splits off in the discharge one or more O-atoms;
- a rare gas (Ar, He, Kr, Ne, Xe) with Hg.

In the silent electrical discharge that is formed, the electron energy distribution can be adjusted optimally by means of the thickness of the dielectrics and their properties of pressure and/or temperature in the discharge space.

When an alternating voltage is applied between the electrodes 3 and 4, a multiplicity of discharge ducts 7 (partial discharges) form in the discharge space 5. These interact with the atoms/molecules of the fill-gas, and this finally leads to UV or VUV radiation.

Instead of a narrow wire netting as the outer electrode 4, it is also possible to use two narrow outer electrodes 4*a* and 4*b* (FIG. 1*b*) spaced from each other, or a wider wire netting that extends approximately over a sixth of the tube circumference (FIG. 1*c*). Instead of a wire netting, it is also possible to use a perforated metal foil or a UV-transparent, electrically conductive coating.

Apart from the solid outer electrodes mentioned above, it is also possible to use a transparent electrolyte. In the embodiment according to FIG. 2, three dielectric tubes 1 having inner dielectric tubes 2 located inside and provided with inner electrodes 3 are immersed in a quartz vessel 8 filled with water 4'. The size of the triggered segment can be varied via the depth of immersion t. Moreover, an additional optical filtering effect can be achieved by appropriate selection of electrolyte: thus, for example, water very effectively blocks from the discharge any infrared radiation present. This is particularly important in the irradiation of substances that are very sensitive to temperature.

FIG. 3 illustrates how a plurality of cylindrical radiators in accordance with FIG. 1*c* can be combined to form a large-area radiator. A carrier body 9 made of an electrically insulating material, but having a good thermal conductivity, for example on a ceramic base, is provided for this purpose with parallel grooves 10 having a semicircular cross-section, which are spaced from one another by more than an outer tube diameter. The grooves 10 are matched to the outer quartz tubes 1 and by coating with a UV-reflecting material, for example aluminum, which is provided with a protective layer made of $MgF_2$. Additional bores 11, which extend in the direction of the tubes 1, serve to cool the individual radiators.

Individual radiators can be combined with different gas fillings and thus different (UV) wavelengths for special applications.

The carrier body 9 need not necessarily be constructed in the shape of a plate. It can also have a hollow cylindrical cross-section having axially parallel grooves regularly distributed over its inner circumference, in which one radiator element is inserted in each case according to FIGS. 1*a* to 1*c*.

The irradiating device in accordance with FIG. 4 basically corresponds to that according to FIG. 3, with additional ducts 12 extending in the longitudinal direction of the carrier body 9. These ducts are connected to the outer space 13 via a multiplicity of bores or slots 14 in the carrier body 9. The ducts 12 are connected to an inert gas source (not represented), for example a nitrogen or argon source. The pressurized inert gas passes from the ducts 12 into the outer space 13 along the path described. In addition, FIG. illustrates a particularly simple and economic embodiment for the outer electrode. This outer electrode is common to all radiators. It consists of a continuous wire netting or wire fabric 15 having semicircular bulges extending in the longitudinal tube direction, which cling to the outer quartz tubes 1.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A high-power radiator, in particular for ultraviolet light, having a discharge space which is filled with a fill-gas emitting radiation under discharging conditions and whose walls are formed by at least one outer dielectric tube and at least one inner dielectric tube, which is provided in each case on the surfaces averted from the discharge space with an inner electrode and at least one outer electrode, and having an alternating current source for feeding the discharge connected to those electrodes, wherein the at least one outer electrode extends only over a fraction of the circumference of the at least one outer tube in such a way that discharges form only in a discharge segment essentially defined by the at least one outer electrode.

2. The high-power radiator as claimed in claim 1, wherein the at least one outer electrode comprises electrode strips extending in the longitudinal tube direction.

3. The high-power radiator as claimed in claim 1, wherein the at least one outer electrode is formed by an electrolyte, into which the at least one outer dielectric tube is immersed at most partially.

4. The high-power radiator as claimed in claim 3, wherein the size of effective emitting segment can be adjusted by means of the depth of immersion (t) of the at least one outer dielectric tube in electrolyte.

5. The high-power radiator as claimed in claim 4, wherein the at least one outer dielectric tube is partially arranged in at least one material recess in a carrier body made of a thermally effectively conductive insulating material.

6. The high-power radiator as claimed in claim 5, wherein cooling bores are provided in the carrier body which do not intersect the at least one material recess.

7. The high-power radiator as claimed in claim 5, wherein the cross-section of the at least one material recess is matched to the outside diameter of the at least one outer dielectric tube, and the walls of the at least one recess are constructed as UV reflectors.

8. The high-power radiator as claimed in one of claims 5 to 7, wherein means are provided outside the at least one outer dielectric tube for supplying inert gas to a space adjacent the at least one outer dielectric tube.

9. The high-power radiator as claimed in claim 8, wherein ducts are provided in the carrier body which are directly or indirectly connected to the said space, through which ducts an inert gas, preferably nitrogen or argon, can be supplied.

10. The high-power radiator as claimed in claim 9, wherein the ducts are arranged in each case between neighboring dielectric tubes and are connected to the said space via bores or slots.

* * * * *